US006648169B1

(12) United States Patent
Berger

(10) Patent No.: US 6,648,169 B1
(45) **Date of Patent: *Nov. 18, 2003**

(54) USER FRIENDLY BEVERAGE CAN

(76) Inventor: Kenneth L. Berger, 33585 Via Corvalian, Dana Point, CA (US) 92629

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 23 days.

(21) Appl. No.: 08/315,629

(22) Filed: Sep. 30, 1994

(51) Int. Cl.[7] ..... A47G 19/22

(52) U.S. Cl. ..... 220/716; 220/269; 220/270; 220/671; 220/906

(58) Field of Search ..... 220/906, 716, 220/671, 675, 608, 623, 269, 270

(56) References Cited

U.S. PATENT DOCUMENTS

| | | | | | |
|---|---|---|---|---|---|
| 3,420,367 | A | * | 1/1969 | Carmichael | 220/906 X |
| 3,704,805 | A | * | 12/1972 | Sheafe, III | 220/716 X |
| 4,024,981 | A | * | 5/1977 | Brown | 220/269 |
| D282,442 | S | * | 2/1986 | Kohnle | D9/392 |
| 4,728,002 | A | * | 3/1988 | Ybanez | 220/906 X |
| 4,925,050 | A | * | 5/1990 | Yu | 220/716 |
| 5,301,830 | A | * | 4/1994 | Muller | 220/669 |
| 5,346,095 | A | * | 9/1994 | Deal | 220/906 X |

* cited by examiner

*Primary Examiner*—Stephen K. Cronin
(74) *Attorney, Agent, or Firm*—Edward S. Irons

(57) ABSTRACT

A beverage can having an indentation on the top portion to accommodate the nose of the consumer and an indentation on the wall portion to accommodate the lip of the consumer, thus minimizing spillage.

19 Claims, 1 Drawing Sheet

USER FRIENDLY BEVERAGE CAN

TECHNICAL FIELD

This invention relates to user friendly beverage cans. More particularly, the invention provides a unique can design which accommodates comfortable no-spill consumption of a contained beverage.

BACKGROUND ART

Beverages are easily and comfortably consumed from open top vessels such as glasses and cups. In contrast, conventional beverage cans have flat tops fitted with lever means positioned at 90° with the can sidewall to provide only a small can top opening when the lever is raised.

The combination of these small openings, the flat can tops and the associated sidewall renders consumption of the contained beverage awkward and uncomfortable. The beverage consumer is compelled on pain of messy spillage to maintain fluid tight pressure by the upper lip against the can top and by the lower lip against the can sidewall.

This necessary manipulation is the more difficult because the impact of the users nose with the flat can top as the can is raised to permit beverage consumption tends to disrupt the relationship necessary for tidy beverage consumption. Nose discomfort and distasteful dribbling occur with disappointing frequency. Particularly so when the can is rotated to facilitate consumption of all of the contained beverage.

U.S. design Pat. No. 282,442 depicts three variations of a beverage can design, each including a single apparent indentation in the upper portion of the cylindrical surface of the can wall. No description of the indentation or of its purpose is set forth.

SUMMARY OF THE INVENTION

This invention provides a user friendly beverage can design which facilitates comfortable dribble-free consumption of the contained beverage.

One embodiment of the invention subsumes a combination of a can wall indentation so positioned with respect to the ridge between the edge at the junction of the can wall and can top as to accommodate the lower lip of the user to the extent desirable for dribble-free consumption of the contained beverage. In a preferred embodiment of the invention, such a can wall indentation is combined with a nose accommodating indentation in the flat can top into which the top opening lever may be depressed.

In some embodiments of the invention, the can sidewall indentation extends along the entire length of the can and preferably includes the rim by which the flat can top is joined to the cylindrical can sidewall.

The sidewall recess, in each embodiment of the invention, provides both for comfortable positioning of the lower lip against the can wall and for an index to be used by the beverage consumer to register the opening of the can by feel, using the thumb, for example, without having to look at the can. It also accommodates a firm grip on chilled beverage cans notwithstanding moisture condensation on the exterior can surface. In this embodiment, the continuous extent of the recess, without a ridge adjacent the joint between the can wall and top, allows comfortable positioning of the lower lip up to the joint with the top. This is the natural positioning of the lower lip, i.e. adjacent the joint with the top. The conventional ridge between the sidewall and can top which disturbs this relationship is eliminated by this embodiment of the invention.

Another embodiment of the invention includes a flattened circular rim at the joint between the can wall and the top adjacent the opening in the top from which the sidewall recess extends. This combination of flattened rim portion and a sidewall recess also facilitates comfortable positioning of the lower lip for drinking.

BRIEF DESCRIPTION OF THE DRAWINGS

The various objects advantages and novel features of the present invention will become more readily apprehended from the following detailed description when taken in conjunction with the appended drawings, in which.

BEST MODE FOR CARRYING OUT THE INVENTION

Figure 1:
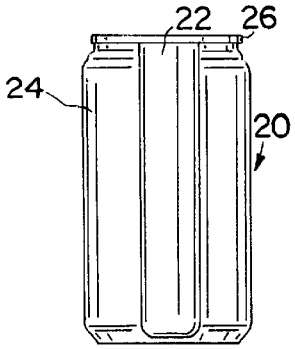
FIG. 1 is a front elevational view of a beverage can showing a first embodiment of the present invention.
Figure 2:
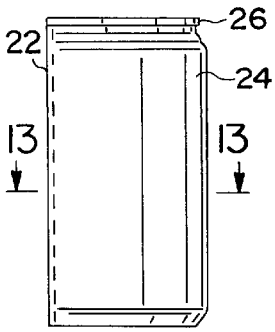
FIG. 2 is a side elevational view of the first embodiment of the present invention as shown in FIG. 1.
Figure 3:
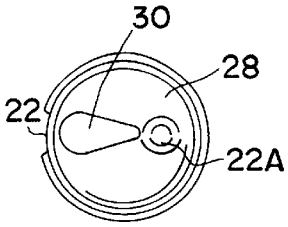
FIG. 3 is a top plan view of the first embodiment of the present invention shown in FIG. 1.
Figure 4:
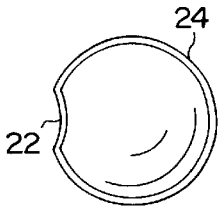
FIG. 4 is a horizontal sectional view of the first embodiment of the present invention as shown in FIG. 1 taken on the line 13—13 of FIG. 2.

Referring now to the drawings, wherein corresponding components are designated by the same reference numerals throughout the various figures, a beverage can design according to the present invention is illustrated in FIG. 1 where it is generally designated by reference numeral 20. As shown in FIG. 1 and associated FIGS. 2–4, there is nose and can opening lever accommodating depression (see FIG. 3) in the can top and an indentation 22 that extends down the vertical length of the beverage can wall 24. The indentation 22 continuously extends from the rim 26, where the beverage can wall 24 is joined to the beverage can top 28, down the entire length of the wall 24. As shown in FIG. 3, the indentation 22 is positioned adjacent that portion of the rim 26 closest to the lever opening means 30 in the top 28. The arrangement is such that the user's lip can be comfortably and securely positioned for drinking. Further, by continuously extending down the length of the wall 24, the indentation 22 provides not only for comfortably and securely positioning the lower lip against the beverage can wall 24, and also provides an index the beverage consumer can use to register the opening of the beverage can 20 by feel, using for example the thumb, without having to look at the can for drinking. The depression 22A accommodates the user's nose particularly when the final portion of the contained beverage is consumed. Thus, the beverage consumer, without having to look down at the beverage can 20, while holding the beverage can 20 in one hand, can rotate the beverage can 20 until the thumb is positioned in the indentation 22. Then the beverage can 20 can be raised to the beverage consumer's lips for drinking because the opening 30 is in the proper position for drinking. It is not necessary that the indentation 22 extend the entire vertical length of the beverage can wall 24 for the rotational registration feature to be used, but it is useful for the indentation 22 to extend down the beverage can wall 24 a sufficient distance that the beverage consumer can register the rotational position of the opening 30 using, for example, the thumb without having to touch that portion of the indentation 22 where the lower lip is to be positioned for drinking.

It is preferred that the indentation 22 extend continuously up to the rim 26 without a protruding ridge being adjacent the rim 26 on the beverage can wall 24. This continuous indentation 22 up to the rim 26, particularly when present in combination with nose depression 22A allows comfortable and dribble-free positioning of the lower lip up to the rim 26, which is the natural position of the lower lip during drinking.

Figure 5:
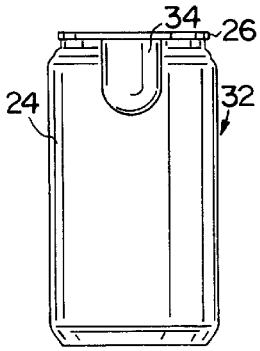
FIG. 5 is a front elevational view of a beverage can showing a second embodiment of the present invention.

A beverage can design according to a second embodiment of the present invention is illustrated in FIG. 5 where it is generally designated by reference number 32. As shown in FIG. 5 and associated FIGS. 6–8, there is an indentation 34 that extends down the vertical length of the beverage can wall 24 a sufficient distance that the lower lip of a beverage consumer would be contained by the indentation without the lower lip extending below the indentation 34 onto the beverage can wall 24. Again there is no ridge adjacent the rim 26 to force any portion of the lower lip back into the beverage consumer's mouth. The embodiment shown in FIG. 7 has an indentation 22A in the can top 28 to receive the lever 30 after it is raised and pushed back to open the can, and also receive the nose of the consumer.

Figure 6:
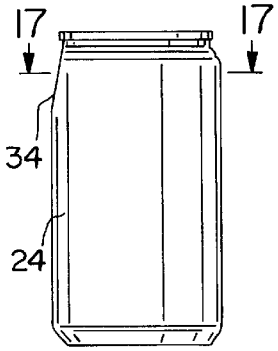
FIG. 6 is a side elevational view of the second embodiment of the present invention as shown in FIG. 5.
Figure 7:
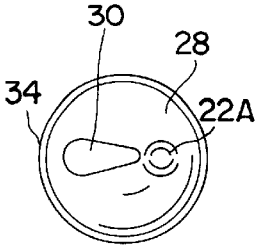
FIG. 7 is a top plan view of the second embodiment of the present invention as shown in FIGS. 5 and 6.
Figure 8:
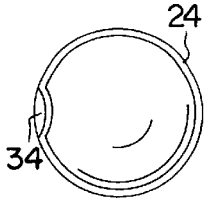
FIG. 8 is a horizontal sectional view of the second embodiment of the present invention as shown in FIG. 5 taken on the line 17—17 of FIG. 6.
Figure 9:
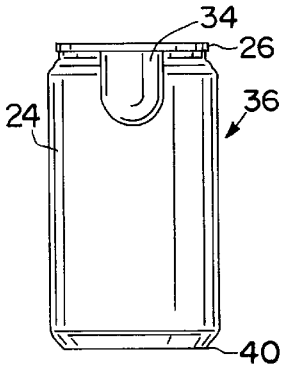
FIG. 9 is a front elevational view of a beverage can showing a third embodiment of the present invention.
Figure 10:
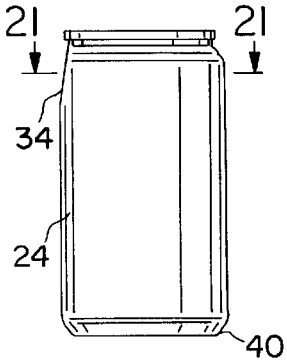
FIG. 10 is a side elevational view of the third embodiment of the present invention as shown in FIG. 9.
Figure 11:
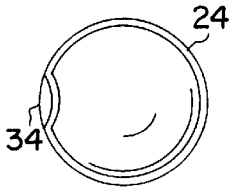
FIG. 11 is a top plan view of the third embodiment of the present invention shown in FIG. 10.
Figure 12:
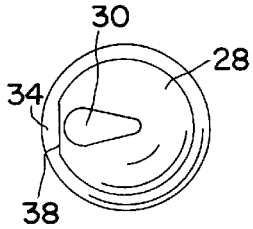
FIG. 12 is a horizontal sectional view of the third embodiment of the present invention taken on the line 21—21 of FIG. 10.

A beverage can design according to a third embodiment of the present invention is illustrated in FIG. 9 where it is generally designated by reference number 36. As shown in FIG. 9 and associated FIGS. 10–12, there is an indentation 34, similar to that of the second embodiment, as shown in FIGS. 5–7, that extends down the vertical length of the beverage can wall 24 a sufficient distance that the lower lip of a beverage consumer would be contained by the indentation without the lower lip extending below the indentation 34 onto the beverage can wall 24. Again there is no ridge adjacent the rim 26 to force any portion of the lower lip back into the beverage consumer's mouth. Further assisting comfortable and secure positioning of the lower lip to the beverage can 36 is a flattened rim portion 38 (see FIG. 11) between the indentation 34 and the opening 30 in the beverage can top 28. This flattened rim portion 38 deviates from the circular arc of the rim 26 to provide a flat portion for resting the lower lip during drinking but does not move that straightened portion of the rim 26 into the area of the can top 28 so as to interfere with stacking of beverage cans as facilitated by lower circular rim 40. So lower circular rim 40 can still be positioned below rim 26 even with the flattened rim portion 38. Thus beverage cans incorporating the third embodiment of the present invention still can be conveniently stacked.

The above discussion and related illustrations of the present invention are directed primarily to a preferred embodiment and practices of the invention. However, it is believed that numerous changes and modifications in the actual implementation of the concepts described herein will be apparent to those skilled in the art, and it is contemplated that such changes and modifications may be made without departing from the scope of the invention as defined by the following claims.

I claim:

1. A beverage container comprising:

a circular top portion secured to a cylindrical wall by a rim, said top portion having means including said rim and to provide an opening for consumption of a beverage in said container;

an indentation in said rim, wherein said indentation extends along said wall at least for a distance equal to the distance said opening in said top portion is spaced from said rim, said indentation being positioned below said rim at a location adjacent said opening in said top, and within the surface area of said indentation there being no portion extending away from the interior volume of said beverage container beyond where said indentation and said wall meet.

2. A beverage container according to claim 1, wherein said rim is flattened along the portion thereof which extends between said opening in said top and said indentation.

3. A beverage container according to claim 1, wherein said indentation extends down the entire length of said cylindrical wall.

4. A beverage container according to claim 3, wherein said rim is a flattened rim between said opening top and said indentation.

5. A beverage container comprising a flat top portion having a perimeter, a wall portion jointed to said perimeter of said top portion, said top portion having means for providing an opening for the consumption of a contained beverage from said container, said container further comprising an indentation in said top portion to accommodate the nose of a person who consumes a contained beverage from said container, and an indentation in said wall portion to accommodate the lower lip of a consumer of a beverage from said container.

6. A beverage container as defined by claim 5 wherein said means for providing an opening for the consumption of a contained beverage from said container comprises a lever which must be raised to provide said opening and wherein said raised lever may be depressed into said indentation in said can top.

7. In a beverage container comprising a top having a perimeter, a bottom, and a cylindrical sidewall positioned therebetween, a rim securing said top to said sidewall at the junction of said perimeter of said top with said sidewall, and opening means in said top to permit consumption of a beverage from said container, the improvement which comprises:

(i) an indentation in said sidewall wherein said indentation (a) includes a flattened portion of said rim and (b) extends downward from said top for a portion only of said sidewall and around a portion only of the circumference of said sidewall adjacent said junction, and wherein (ii) said indentation is dimensioned and shaped to accommodate the lower lip of a consumer of a beverage from said container when said container is raised to accommodate flow of said beverage through said opening means in said top, and wherein (iii) comfortable no-spill consumption of said contained beverage is facilitated.

8. The claim 7 beverage container, wherein said indentation extends continuously downward from said top for a distance only sufficient that the lower lip of the consumer is accommodated by said indentation but said lower lip does not extend below the indentation on to the can wall.

9. The claim 7 or claim 8 beverage container, wherein said indentation is juxtaposed to said opening means in said can top to permit consumption of a beverage from said container.

10. The claim 7 or claim 8 beverage container, further comprising a nose-accommodating indentation adjacent said opening means in said top.

11. The claim 7 beverage container, wherein said indentation extends continuously downward from said top for a portion only of the length of said sidewall.

12. The claim 7 beverage container, wherein said indentation extends continuously downward from said top along the entire length of said sidewall.

13. In a beverage container comprising a bottom, a top, opening means in said top, and a cylindrical sidewall positioned between said bottom and said top, said sidewall having a first circumferential indentation defining a ridge between a lower portion of said sidewall and an upper portion of said sidewall, said upper portion of said sidewall being of smaller diameter than said lower portion of said sidewall and joint means securing said top to said upper portion of said sidewall, the improvement which comprises:

(i) a second indentation in said sidewall wherein said second indentation (a) includes said joint means and said ridge defined by said first circumferential indentation in said sidewall and an adjacent portion of said top and (b) extends continuously downward from said top around a portion only of said circumference of said sidewall, and wherein (ii) said indentation is dimensioned and shaped to accommodate the lower lip of a consumer of a beverage from said container when said container is raised to accommodate flow of said beverage through an opening provided by said opening means in said top, and wherein (iii) comfortable no-spill consumption of said contained beverage is facilitated.

14. The claim 13 beverage container, wherein said indentation extends continuously downward from said top for a distance only sufficient that the lower lip of the consumer is accommodated by said indentation but said lower lip does not extend below the indentation on to the can wall.

15. The claim 13 or claim 14 beverage container, wherein said indentation is juxtaposed to said opening means in said can top to permit consumption of a beverage from said container.

16. The claim 13 or claim 14 beverage container, further comprising a nose-accommodating indentation adjacent said opening means in said top.

17. The claim 13 beverage container, wherein said indentation extends continuously downward from said top for a portion only of the length of said sidewall.

18. The claim 13 beverage container, wherein said indentation extends continuously downward from said top along the entire length of said sidewall.

19. In a beverage container comprising a bottom, a top, a cylindrical sidewall positioned between said bottom and said top, said sidewall having a first circumferential portion defining a ridge between a lower portion of said sidewall and an upper portion of said sidewall adjacent said top, said upper portion of said sidewall being of smaller diameter than said lower portion of said sidewall and rim means securing said top to said upper portion of said sidewall, the improvement which comprises:

(i) a second indentation in said sidewall wherein said second indentation (a) includes said ridge and a flattened portion of said rim means and (b) extends continuously downward from said rim means around a portion only of said sidewall, and wherein (ii) said indentation is dimensioned and shaped to accommodate the lower lip of a consumer of a beverage from said container when said container is raised to accommodate flow of said beverage through an opening provided by said opening means in said top, and wherein (iii) comfortable no-spill consumption of said contained beverage is facilitated.

* * * * *

UNITED STATES PATENT AND TRADEMARK OFFICE

CERTIFICATE OF CORRECTION

PATENT NO. : 6,648,169 B1
DATED : November 18, 2003
INVENTOR(S) : Kenneth L. Berger It is certified that error appears in the above-identified patent and that said Letters Patent is hereby corrected as shown below:

Column 4,
Line 12, insert after the word “rim”, the words -- and said wall below said rim --
Lines 15-16, delete the words “below said rim”

Signed and Sealed this

Eighteenth Day of May, 2004

JON W. DUDAS
*Acting Director of the United States Patent and Trademark Office*